US005783143A

United States Patent [19]

Handa et al.

[11] Patent Number: 5,783,143

[45] Date of Patent: Jul. 21, 1998

[54] ALLOY STEEL RESISTANT TO MOLTEN ZINC

[76] Inventors: Takuo Handa; Tomohiko Nakajima; Kazuyoshi Arikata, all of Nippon Chuzo K.K., 2-1 Shiraishi-cho Kawasaki-ku Kawasaki-shi, Kanagawa-ken, Japan

[21] Appl. No.: 685,091

[22] Filed: Jul. 23, 1996

Related U.S. Application Data

[63] Continuation-in-part of Ser. No. 390,363, Feb. 17, 1995, abandoned.

[30] Foreign Application Priority Data

Feb. 18, 1994 [JP] Japan ..... 6-043256
Feb. 9, 1995 [JP] Japan ..... 7-043667

[51] Int. Cl.[6] ..... C22C 38/44; C22C 30/00

[52] U.S. Cl. ..... 420/52; 420/586.1

[58] Field of Search ..... 420/52, 586.1

[56] References Cited

U.S. PATENT DOCUMENTS 3,854,937 12/1974 Muta et al. .
4,172,716 10/1979 Abo et al. ..... 420/586.1

FOREIGN PATENT DOCUMENTS 112444 9/1981 Japan ..... 420/586.1
1079582 8/1967 United Kingdom .

*Primary Examiner*—Deborah Yee
*Attorney, Agent, or Firm*—Carol I. Bordas

[57] ABSTRACT

The object of the present invention is to provide an alloy steel having excellent erosion resistance to molten zinc and used as a material for parts and members for molten zinc plating facilities, e.g. sink roll, coating roll, roll frame and snout. The alloy in the present invention consists essentially of, by weight percent, about 0.10 to 0.17 wt % of carbon, from about 0.30 to 2% of silicon, from about 0.30 to about 2% manganese, from about 10% to 20% nickel, from about 20% to about 35% chromium, from about 0.50% to about 5% molybdenum and from not less than about 0.40% to about 0.75% nitrogen, the balance consisting of substantially of Fe, and unavoidable impurities. Tungsten, from about 0.5% to about 5%, may also be added to enhance the strength of the alloy.

3 Claims, 3 Drawing Sheets

Effects of N on the mechanical properties

ALLOY STEEL RESISTANT TO MOLTEN ZINC

This application is a continuation-In-part of application Ser. No. 08/390,363 filed Feb. 17, 1995, now abandoned.

BACKGROUND OF THE INVENTION

The present invention relates to an alloy steel having excellent erosion resistance to molten zinc and used as a material for parts and members for molten zinc plating facilities, e.g. sink roll, coating roll, roll frame and snout.

DESCRIPTION OF THE RELATED ART

Conventionally, the parts and members for facilities plating steel with molten zinc, e.g. sink roll, coating roll, roll frame and snout, have been manufactured by centrifugation casting, sand mold casting or forging of stainless steel such as SUS309S (SAE30309S), SUS316 (SAE30316) and SUS316L (SAE30316L).

In the plating of steel material with molten zinc, a molten zinc bath of usually Zn and 0.2 wt % Al has been conventionally used, but in recent years, there is a tendency to increase the Al content in a molten zinc bath by adding e.g. 5–55 wt % Al and other elements, to further improve the erosion resistance of zinc deposit on steel material.

Because the use of such a molten zinc bath having higher content of Al provides the parts and members for molten zinc plating facilities with more severe environments with respect to erosion, the prior art material has disadvantages such as high erosion and, hence, inferior durability.

Muta, et al. (U.S. Pat. No. 3,854,937) discloses a pitting corrosion resistant ausenite stainless steel which contains a low carbon content of 0.08 wt % and a higher nitrogen content of 0.30 to 0.45 wt %. However, the use of this steel is limited to an aqueous solution like sea water which contains some chlorine ions.

British Patent No. 1,079,582 discloses a corrosion resistant stainless steel for sea water use. This kind of steel cannot be used as a material for the parts and members for facilities plating steel with molten zinc because the corrosion mechanism is different in sea water then in molten zinc.

In view of the foregoing problem of the related art, it is the object of the invention to provide a material from which one can obtain parts for molten zinc plating facilities excellent in durability with less erosion even in a molten zinc bath of high content of Al. Hence, the object of the invention is to provide a material which is excellent in erosion resistance to molten zinc and suitable as a material for use in parts and members for molten zinc plating facilities, e.g. sink roll, coating roll, roll frame and snout in the case of a molten zinc plating bath having high content of Al.

SUMMARY OF THE INVENTION (1) A first embodiment of the present invention is a member or a part for a molten zinc plating facility manufactured of an alloy steel having an increased resistance to molten zinc consisting essentially of; C: from 0.10 wt % to 0.17 wt %, Si: from 0.3 wt % to 2 wt %, Mn: from 0.3 wt % to 2 wt %, Ni: from 10 wt % to 20 wt %, Cr: from 20 wt % to 35 wt %, Mo: from 0.5 wt % to 5 wt % and N: from 0.4 wt % to 0.75 wt %, the balance consisting substantially of Fe and unavoidable impurities.

(2) A second embodiment of the present invention is a member or a part for a molten zinc plating facility manufactured of an alloy steel having an increased resistance to molten zinc consisting essentially of; C: 0.17 wt % or less, Si: from 0.3 wt % to 2 wt %, Mn: from 0.3 wt % to 2 wt %, Ni: from 10 wt % to 20 wt %, Cr: from 20 wt % to 35 wt %, Mo: from 0.5 wt % to 5 wt %, N: from 0.35 wt % to 0.75 wt % and W: from 0.5 wt % to 5 wt %, the balance consisting substantially of Fe and unavoidable impurities.

(3) A third embodiment of the present invention, only C is between 0.10 wt % to 0.17 wt % in the second embodiment of the present invention.

DETAILED DESCRIPTION OF THE INVENTION

Figure 1:
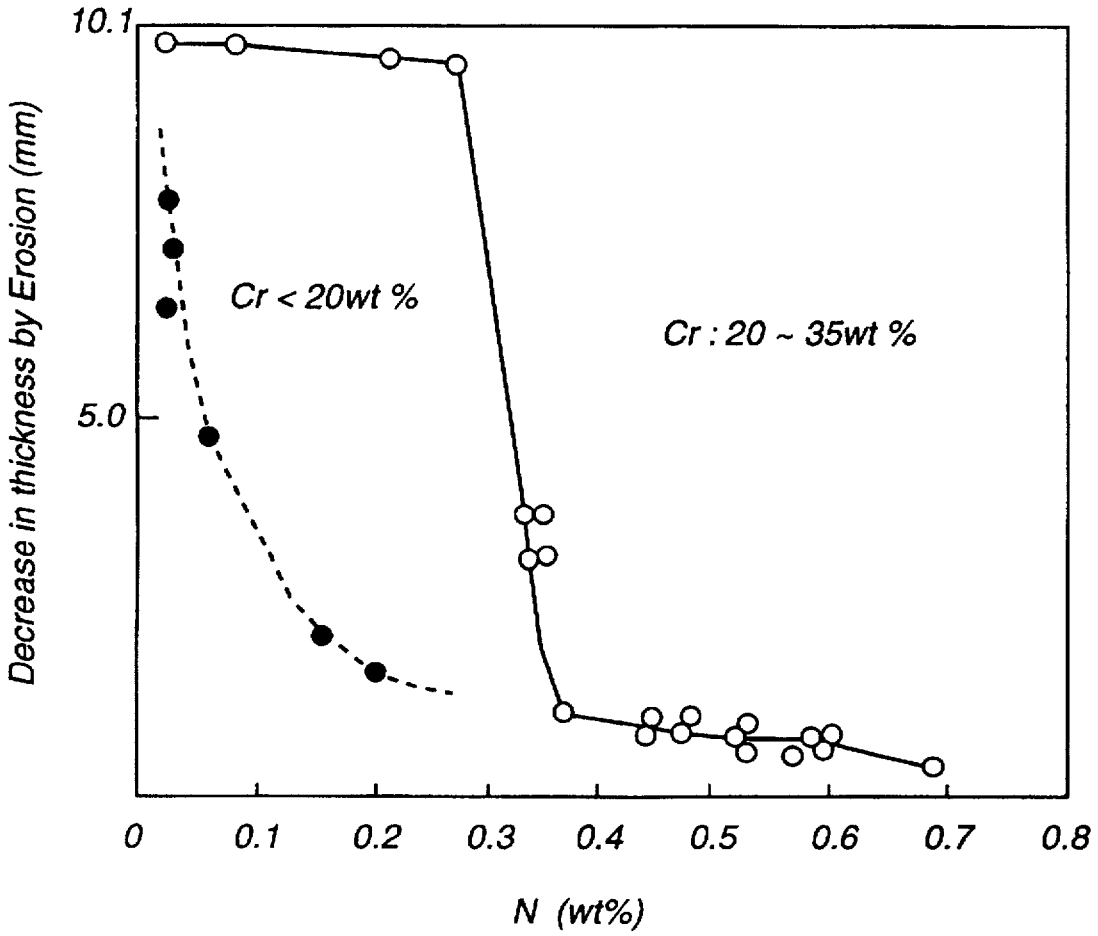
FIG. 1 is a graph showing the relationship between erosion and N content in the alloy steel.

As a result of the studies on the mechanism of the erosion of stainless steel by zinc containing high Al content, the inventors found that particularly Al in zinc, reacts with Fe to erode the parts and members for molten zinc plating facilities, and also that the erosion reaction can be prevented by adding large amounts of Cr and N to the material for the parts and members.

In the following, the reasons for limiting the content of each component constituting the molten zinc resistant alloy steel of the invention will be described.

C: 0.10 wt % to 0.17 wt % or 0.17 wt % or less

C (carbon) is an element necessary for enhancing the strength of alloy. However, if the content exceeds 0.17 wt %, carbide is precipitated in crystalline boundaries to deteriorate erosion resistance and therefore, the content selected is 0.17 % or less.

And when tungsten is not contained, carbon content should be 0.10 wt % or more to enhance the strength of the alloy.

When tungsten is contained, the strength of the alloy is reinforced by the presence of tungsten. Then, the lower limit of carbon is not always required. However, when carbon content is higher, a part of carbon is combined to produce $Cr_nC_m$ (chromium carbide) along the grain boundary, which reduces the erosion resistance. Hence, W is preferrably added to the alloy steel to precipitate WC (tungsten carbide), reducing the precipitation of $Cr_nC_m$ and therefore a better erosion resistance is realized.

Si: 0.3–2 wt %

Since Si(silicon) is an element which is added as a deoxidizing agent in the melting step of the alloy and is effective for improving erosion resistance, 0.3 wt % or more is required. However, if the content exceeds 2 wt %, the ductility of the steel is deteriorated and thus, the content selected is between 0.3 and 2 wt %.

Mn: 0.3–2 wt %

Since Mn(manganese) is an element which is added as a deoxidizing and desulfurizing agent in the melting step and contributes to the formation of austenite phase, 0.3 wt % or more is required. However, if the content exceeds 2 wt %, the erosion resistance is deteriorated and thus, the content selected is between 0.3 and 2 wt %.

Ni: 10–20 wt %

Ni(nickel) is an element effective for stabilization of austenite phase as well as for improvement of erosion resistance. However, if the content is less than 10 wt %, the effects for stabilization of austenite phase are not brought about, while if the content exceeds 20 wt %, no additional improvements in the effects are obtained, resulting merely in higher costs. Hence, the content selected is between 10 and 20 wt %.

Cr: 20–35 wt %

The function of Cr(chromium) is to effectively enhance the erosion resistance of the alloy in combination with elements such as Ni and other elements when the matrix of the alloy is composed of austenite only. When Cr content is increased, the amount of N effective for preventing erosion caused by molten zinc should be increased. However, an amount of less than 20 wt % of Cr does not yield the desired effects, whereas the addition of more than 35 wt % causes precipitation of δ ferrite phase, resulting in the undesired deterioration of erosion resistance and ductility. Hence, the content selected is between 20 and 35 wt %.

Mo: 0.5–5 wt %

Mo(molybdenum) is an element effective for improving erosion resistance. However, the content of less than 0.5 wt % does not yield the effects, whereas the addition of more than 5 wt % deteriorates the ductility of alloy steel and results merely in higher costs, and thus, the content selected is between 0.5 and 5 wt %. From an economical point of view, the range from 0.5 wt % to less than 3.0 wt % is more preferable.

N: from 0.35 wt % to 0.75 wt %

N(nitrogen) is a strong austenite-forming element, and is the most effective element for improving erosion resistance and enhances the strength and ductility of alloy steel. FIG. 1 shows the relationship between the N content in the alloy steel of the invention and the decrease in thickness (mm) of test samples immersed in molten zinc bath by erosion in a test described later. The figure shows that 0.1 wt % N or more is effective when Cr content is less than 20 wt %. When the N content is 0.35 wt % or more, a significant decrease in erosion when the Cr content is not less than 20 wt % results. However, the present invention prefers a Cr content of 20 wt % or more and an N content of 0.35 wt % or more. More preferably, an N content of 0.4 wt % or more as shown in FIG. 1 is desired.

Figure 2:
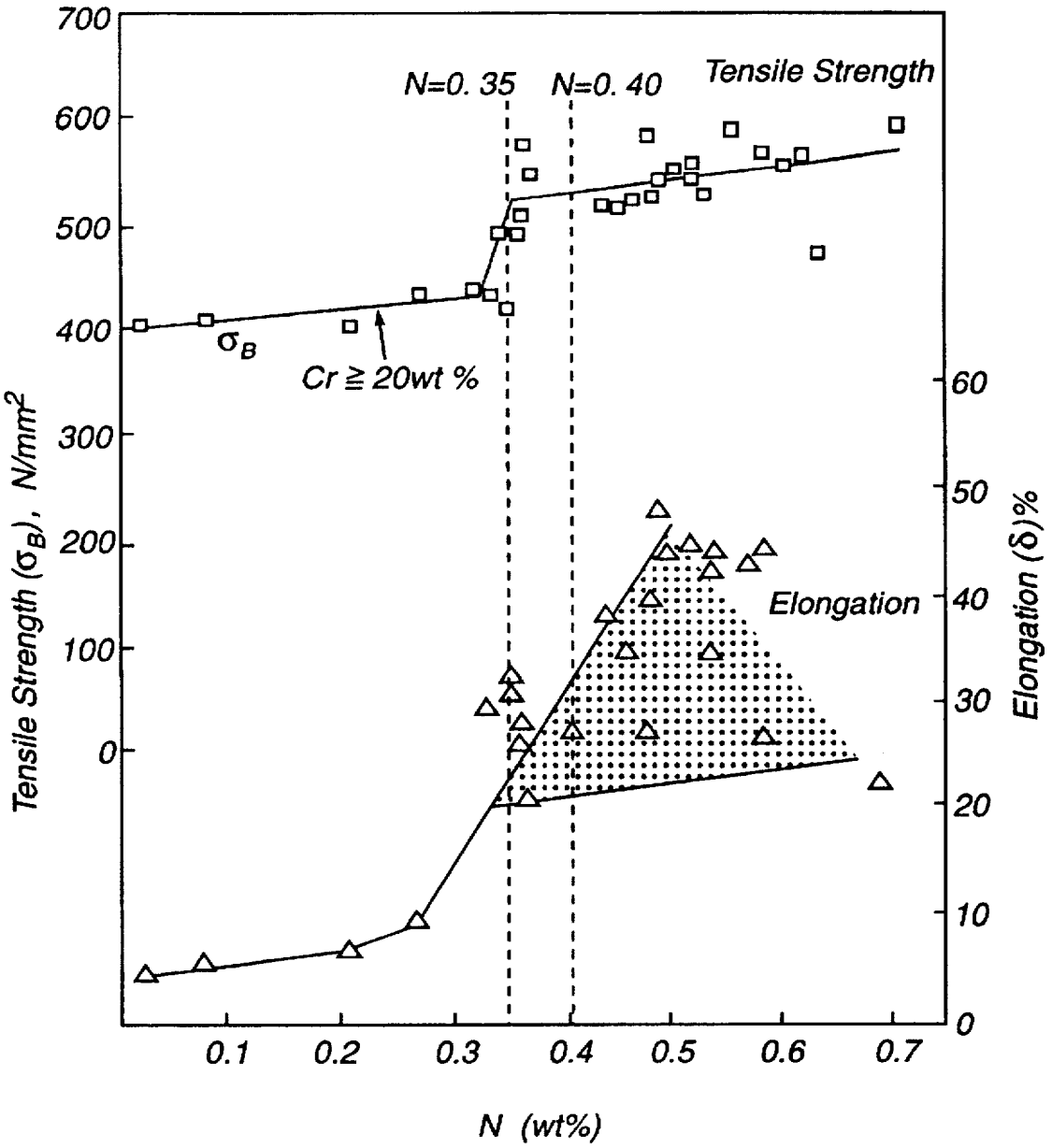
FIG. 2 is a graph showing the relationship between mechanical properties and the nitrogen content of the alloy steel.

And moreover, the strength and the ductility of the alloy is increased when N content is 0.35 wt % or more, as is shown in FIG. 2, which represents the relation between the N content and the mechanical properties of the alloy steel. As shown in FIGS. 1 and 2, an N content of less than 0.35 wt % is not effective to secure the erosion resistance and moreover, induces the precipitation of a network δ ferrite phase along the austenite grain boundary, which enhances the crack-susceptibility of the alloy steel.

Meanwhile, an N content of more than 0.75 wt % results in the significant precipitation of nitride to deteriorate ductility as well as the soundness of the product.

The content of N is, therefore, selected from 0.35 wt % to 0.75 wt % and more preferably between 0.4 and 0.75 wt %. Although the mechanism of the influence of N on the resistance of this alloy steel to the erosion of molten zinc is not fully elucidated, the erosion resistance is significantly enhanced by the addition of N. This enhancement in erosion resistance is estimated to be due to the formation of AlN on the surfaces of the parts and members of the alloy steel. Such erosion resistance is not anticipated from the prior corrosion mechanism of stainless steel.

W: 0.5–5 wt %

Figure 3:
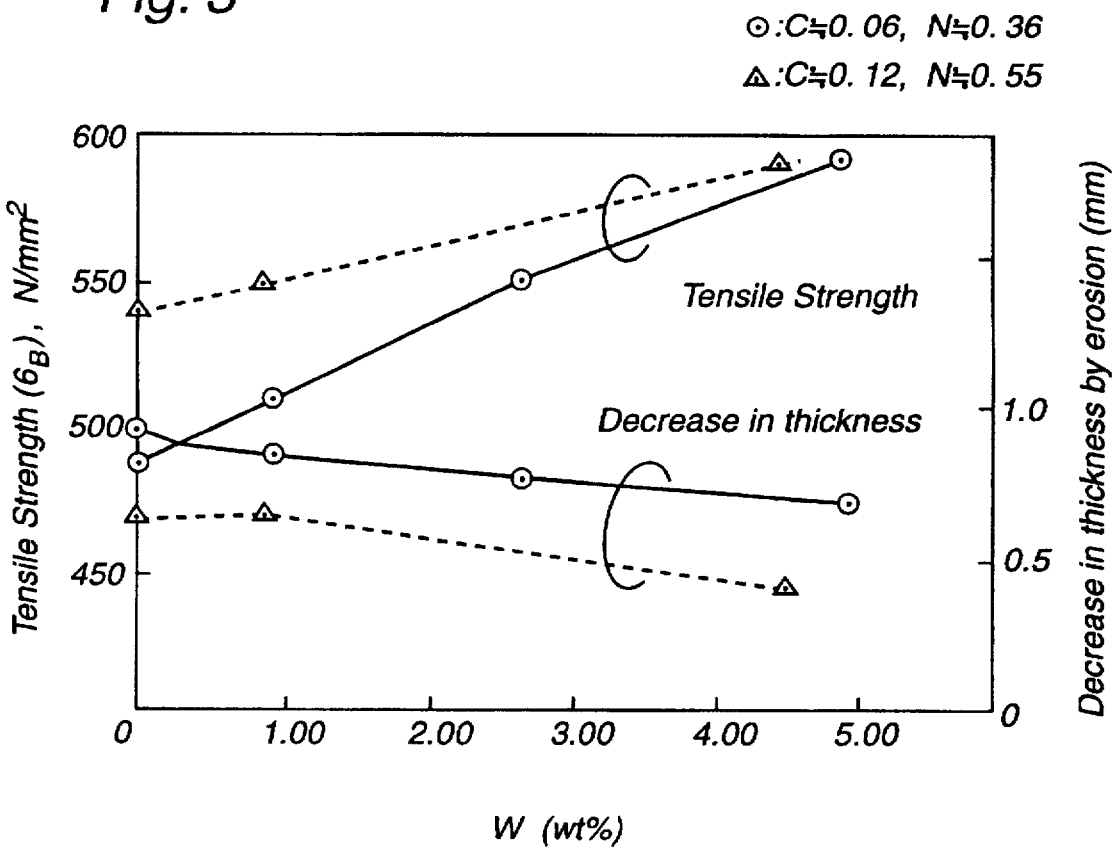
FIG. 3 is a graph showing the relationship between erosion and mechanical properties with the tungsten content of the alloy steel.

W (tungsten) is an element which enhances the strength of the alloy by producing the solid solution thereof, as shown in FIG. 3, which visualizes the effect of W on tensile strength and the erosion resistance of the alloy steel. W is combined with carbon to precipitate WC (tungsten carbide) in the matrix and reduces a possibility of carbide graphite precipitation along the grain boundary, and is effective for improving erosion resistance particularly in the environments in which a molten zinc bath flows. When W content is less than 0.5 wt %, the effect of tungsten is not clearly observed as shown in FIG. 3.

However, if the content of W exceeds 5 wt %, it is not possible to obtain the effects in proportion with the costs, and thus, the amount selected is between 0.5 and 5 wt %. Therefore, a preferable W content is between 0.5 and 5 wt %.

Impurities such as P, S, etc., may be present insofar as their amount is within the usual range (e.g. 0.040% or less) in the conventional steel.

Cu, Ti, Nb, Ta, Zr, V, B and other trace elements may be present as far as they do not alter the properties of this type of austenite stainless steel. A working example of the invention will now be described.

EXAMPLE 1

The alloy steels with each composition shown in Tables 1 and 2 were prepared in a high frequency induction furnace and then casted into specimens of 60×310×30 (thickness) mm in size. Then, the specimens thus obtained were machined into specimens of 50×300×20 (thickness) mm in size.

To evaluate erosion resistance, each specimen was immersed for 336 hours in a Zn-55 wt % Al bath at 600° C. as shown in Table 3, and the decrease (mm) in thickness of one side of each of the specimens was determined to evaluate the erosion resistance of the alloy steel.

The results are shown in Tables 1 and 2. Comparison of Tables 1 and 2 indicates that the invented alloy steels have a higher strength are more resistant to erosion than the conventional and comparative steels. As evidenced by a 1.5 mm or more decrease in thickness, Specimen Nos. 1–16, underwent high erosion.

With respect to the decreased thickness by erosion only, a nitrogen content of 0.35 wt % or more, unexpectedly showed superior results by indicating a decreased thickness less than 1.0 mm. Meanwhile, the present alloy steel, which does not contain W (Nos. 18–22) has a higher yield strength or tensile strength when carbon content is 0.10 wt % or more in general.

The W containing specimens show a slightly higher erosion resistance and a higher tensile strength than specimens not containing any W content. Additionally, W containing specimens showed a higher erosion resistance and a higher tensile strength than specimens not containing W.

As stated above, it is clear that a member or a part for a molten zinc plating facility manufactured of an alloy steel consisting essentially of the elements having the above-mentioned content of the elements has a greatly increased resistance to molten zinc.

In the above context, a member or a part for a molten zinc plating facility is defined as a member or a part which is in direct contact with molten zinc such as molten zinc bath and also has an indirect contact with molten zinc such as pulling rolls for pulling a plated steel sheet from the zinc bath.

TABLE 1

| | No | C | Si | Mn | Ni | Cr | Mo | W | N | Decr. thick (mm) | Y.S N/mm² | T.S N/mm² | El. (%) |
|---|---|---|---|---|---|---|---|---|---|---|---|---|---|
| | | chemical components (wt %) | | | | | | | | | | | |
| Conv. compa. steel | 1 | 0.03* | 0.68 | 1.27 | 12.02 | 17.10* | 2.08 | — | 0.03* | 7.8 | 184 | 499 | 60 |
| | 2 | 0.05* | 2.36* | 0.74 | 13.87 | 18.69* | 2.49 | — | 0.02* | 7.1 | 166 | 415 | <10 |
| | 3 | 0.09* | 0.96 | 0.86 | 14.86 | 17.98* | 2.06 | — | 0.03* | 6.5 | 161 | 401 | 36 |
| | 4 | 0.05* | 1.12 | 1.33 | 15.80 | 18.53* | 1.01 | — | 0.08* | 4.8 | 171 | 423 | 35 |
| | 5 | 0.18* | 1.15 | 1.68 | 13.99 | 26.23 | 0.93 | — | 0.35* | 3.6 | 268 | 492 | 31 |
| | 6 | 0.07* | 1.16 | 1.69 | 9.58* | 26.25 | 0.64 | — | 0.33* | 3.5 | 206 | 435 | 30 |
| | 7 | 0.05* | 1.12 | 1.58 | 14.01 | 26.53 | 0.34* | — | 0.35* | 2.8 | 242 | 423 | 32 |
| | 8 | 0.06* | 1.09 | 1.75 | 14.08 | 26.22 | 5.53* | — | 0.34* | 2.9 | 255 | 434 | <10 |
| | 9 | 0.07* | 1.12 | 1.69 | 13.91 | 39.68* | 0.99 | — | 0.63 | 4.4 | 257 | 471 | <10 |
| | 10 | 0.06* | 1.18 | 1.78 | 13.97 | 34.99 | 1.01 | — | 0.8* | ND** | ND** | ND** | ND** |
| | 11 | 0.07* | 1.09 | 1.68 | 18.87 | 18.13* | 0.98 | — | 0.15* | 2.0 | 194 | 438 | 33 |
| | 12 | 0.05* | 1.21 | 1.79 | 16.87 | 19.25* | 0.99 | — | 0.21* | 1.5 | 210 | 466 | 32 |
| | 13 | 0.06* | 0.90 | 1.76 | 13.81 | 25.22 | 0.93 | — | 0.02* | 9.9 | 187 | 407 | <10 |
| | 14 | 0.05* | 0.81 | 1.72 | 13.88 | 26.23 | 0.97 | — | 0.08* | 9.8 | 195 | 411 | <10 |
| | 15 | 0.06* | 1.04 | 1.59 | 14.22 | 24.92 | 0.95 | 0.99 | 0.21* | 9.6 | 249 | 405 | <10 |
| | 16 | 0.07* | 1.12 | 1.65 | 17.35 | 31.26 | 0.98 | 3.64 | 0.27* | 9.5 | 254 | 428 | <10 |
| | 17 | 0.08* | 1.16 | 1.79 | 14.08 | 25.23 | 0.92 | — | 0.36* | 1.0 | 251 | 489 | 27 |

(Note: *Out of the scope of present invention **Not measured owing to occurrence of blow-hole defect)

TABLE 2

| | No | C | Si | Mn | Ni | Cr | Mo | W | N | Decreased thickness (mm) | Y.S N/mm² | T.S N/mm² | El. (%) |
|---|---|---|---|---|---|---|---|---|---|---|---|---|---|
| | | chemical components (wt %) | | | | | | | | | | | |
| invent. steel | 18 | 0.17 | 0.99 | 1.61 | 13.96 | 25.10 | 0.91 | — | 0.49 | 1.1 | 266 | 536 | 45 |
| | 19 | 0.13 | 1.02 | 1.61 | 13.99 | 24.92 | 0.95 | — | 0.45 | 0.9 | 270 | 527 | 35 |
| | 20 | 0.15 | 1.03 | 1.68 | 13.83 | 24.75 | 0.95 | — | 0.47 | 1.0 | 275 | 537 | 40 |
| | 21 | 0.10 | 1.12 | 1.58 | 13.79 | 24.90 | 0.94 | — | 0.54 | 0.7 | 277 | 540 | 43 |
| | 22 | 0.12 | 1.10 | 1.80 | 13.50 | 24.70 | 0.93 | — | 0.62 | 0.7 | 284 | 557 | 45 |
| | 23 | 0.07 | 1.18 | 1.78 | 14.06 | 26.43 | 0.92 | 0.97 | 0.36 | 0.9 | 262 | 509 | 28 |
| | 24 | 0.06 | 1.22 | 1.65 | 14.22 | 26.44 | 0.95 | 2.65 | 0.37 | 0.8 | 294 | 547 | 25 |
| | 25 | 0.06 | 1.09 | 1.78 | 13.78 | 26.41 | 0.96 | 4.88 | 0.36 | 0.7 | 312 | 573 | 20 |
| | 26 | 0.15 | 1.00 | 1.64 | 13.97 | 24.92 | 0.96 | 0.98 | 0.44 | 0.9 | 276 | 542 | 38 |
| | 27 | 0.08 | 1.10 | 1.68 | 13.78 | 25.43 | 0.92 | 0.97 | 0.52 | 0.6 | 280 | 552 | 45 |
| | 28 | 0.07 | 1.09 | 1.72 | 13.50 | 25.44 | 0.93 | 4.88 | 0.48 | 0.6 | 330 | 577 | 26 |
| | 29 | 0.10 | 1.05 | 1.65 | 13.78 | 24.54 | 0.94 | 0.96 | 0.62 | 0.5 | 312 | 561 | 37 |
| | 30 | 0.17 | 1.05 | 1.69 | 13.79 | 24.60 | 0.95 | 2.55 | 0.69 | 0.4 | 326 | 599 | 24 |
| | 31 | 0.17 | 0.98 | 1.50 | 13.88 | 25.11 | 0.96 | 0.98 | 0.53 | 0.8 | 293 | 559 | 36 |
| | 32 | 0.13 | 0.95 | 1.57 | 13.44 | 25.12 | 0.92 | 0.94 | 0.53 | 0.7 | 284 | 549 | 45 |
| | 33 | 0.12 | 0.95 | 1.53 | 13.86 | 25.01 | 0.95 | 4.50 | 0.56 | 0.4 | 337 | 590 | 25 |
| | 34 | 0.14 | 1.05 | 1.70 | 13.41 | 25.45 | 0.92 | 0.94 | 0.58 | 0.6 | 290 | 557 | 42 |

TABLE 3

| Chemical component in Zn bath | Zn - 55 wt % Al |
|---|---|
| bath temperature | 600° C. |
| time of immersion | 336 hrs (2 weeks) |
| size of test piece | 500 × 300 × 20 (thick) (mm) |

We claim:

1. A member or a part of zinc plating facility, having contact with molten zinc, manufactured of an alloy steel having an increased resistance to molten zinc consisting essentially of: C: from 0.10 wt % to 0.17 wt %; Si: from 0.3 wt % to 2 wt %; Mn: from 0.3 wt % to 2 wt %; Ni: from 10 wt % to 20 wt %; Cr: from 20 wt % to 35 wt %; Mo: from 0.5 wt % to 5 wt % and N: from 0.4 wt % to 0.75 wt %, the balance consisting substantially of Fe and unavoidable impurities.

2. A member or a part of zinc plating facility, having contact with molten zinc, manufactured of an alloy steel having an increased resistance to molten zinc consisting essentially of: C: 0.17 wt % or less, Si: from 0.3 wt % to 2 wt %, Mn: from 0.3 wt % to 2 wt %, Ni: from 10 wt % to 20 wt %, Cr: from 20 wt % to 35 wt %, Mo: from 0.5 wt % to 5 wt %, N: from 0.35 wt % to 0.75 wt % and W: from 0.5 wt % to 5 wt %, the balance consisting substantially of Fe and unavoidable impurities.

3. A member or a part of zinc plating facility, having contact with molten zinc, manufactured of an alloy steel having an increased resistance to molten zinc as recited in claim 2, wherein carbon content is from 0.10 wt % and 0.17 wt %.

* * * * *